United States Patent [19]

Hughes

[11] 4,253,663

[45] * Mar. 3, 1981

[54] GOLF SWING MUSCLE DEVELOPER

[76] Inventor: Ralph L. Hughes, 6014 S. Croft Ave., Los Angeles, Calif. 90056

[ * ] Notice: The portion of the term of this patent subsequent to Jan. 23, 1996, has been disclaimed.

[21] Appl. No.: 912,761

[22] Filed: Jun. 5, 1978

[51] Int. Cl.[3] ..... A63B 21/18

[52] U.S. Cl. ..... 272/136; 272/133

[58] Field of Search ..... 272/62, 63, 67, 109, 272/111, 116, 131-142; 273/191 B

[56] References Cited

U.S. PATENT DOCUMENTS

| | | | |
|---|---|---|---|
| 518,967 | 5/1894 | Poole | 272/132 |
| 1,137,349 | 4/1915 | Patterson | 273/191 B X |
| 2,817,523 | 12/1957 | Lasky et al. | 272/62 |
| 3,013,799 | 12/1961 | Wise | 272/132 |
| 3,430,953 | 3/1969 | Teetor | 272/62 |
| 3,462,156 | 8/1969 | Gentry | 273/191 B X |
| 3,593,996 | 7/1971 | Thompson | 272/62 |
| 3,804,420 | 4/1974 | Boyd | 273/191 B X |
| 4,114,874 | 9/1978 | Mattila | 272/132 X |
| 4,135,714 | 1/1979 | Hughes | 272/142 X |

*Primary Examiner*—Richard J. Apley

[57] ABSTRACT

This invention consists of a rotatable pulley or reel attached to an inverted U-shaped mounting bracket, with a flexible cord attached to and wound around the pulley or reel, whose rotation is retarded or resisted by the strong force or tension of a coiled spring or elastic cord, with a handle of wood or other material attached to the other end of the flexible cord so that when the inverted U-shaped mounting bracket is hooked or fitted in place over the horizontal top of a door or other appropriate support the handle may be pulled downward and away from the pulley or reel in a simulated golf stroke downswing to unwind the flexible cord as it rotates the pulley or reel against the strong force or tension of the retarding or resisting coiled spring or elastic cord that is connected to the pulley or reel. By making many repeated downswings against the strong force of the resistance to the rotation of the pulley or reel all muscles used in driving a golf ball are strained and strengthened, enabling the golfer to drive a golf ball farther when playing on a golf course.

4 Claims, 9 Drawing Figures

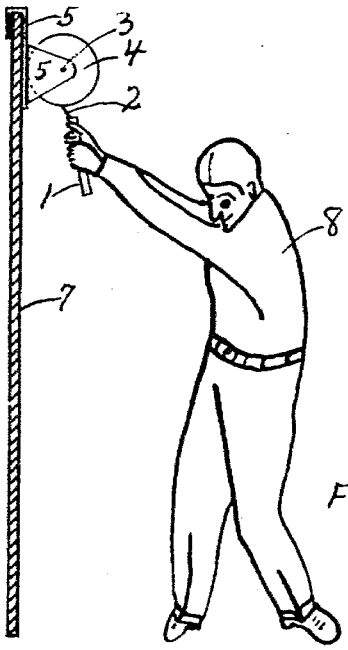
Fig. 1
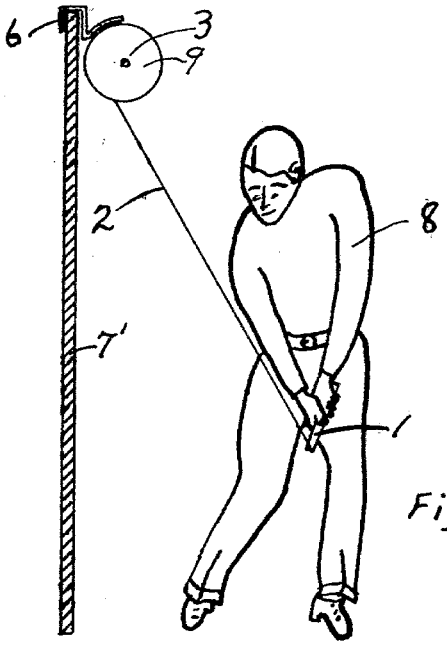
Fig. 2
Fig. 5
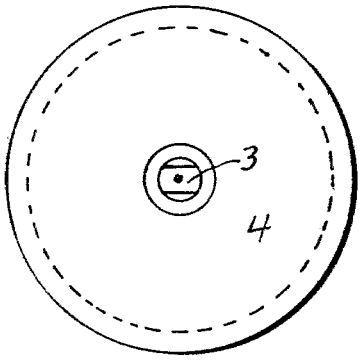
Fig. 6
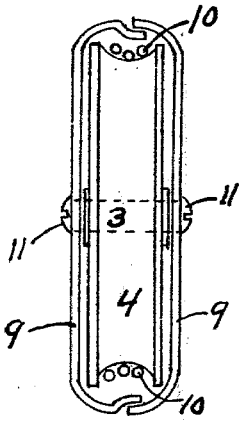
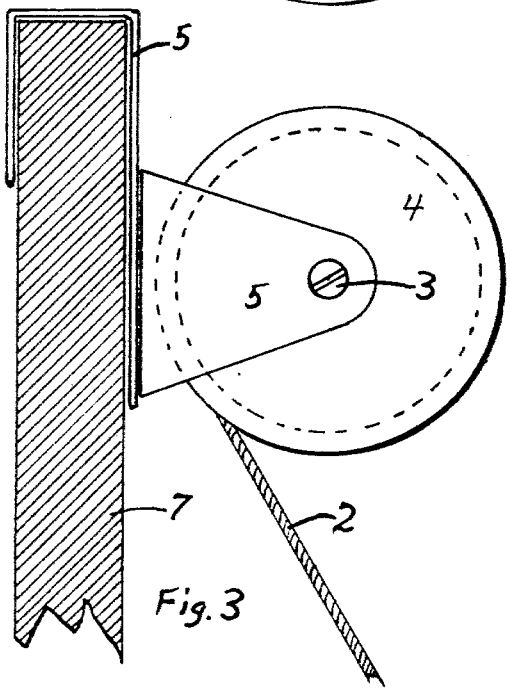
Fig. 3
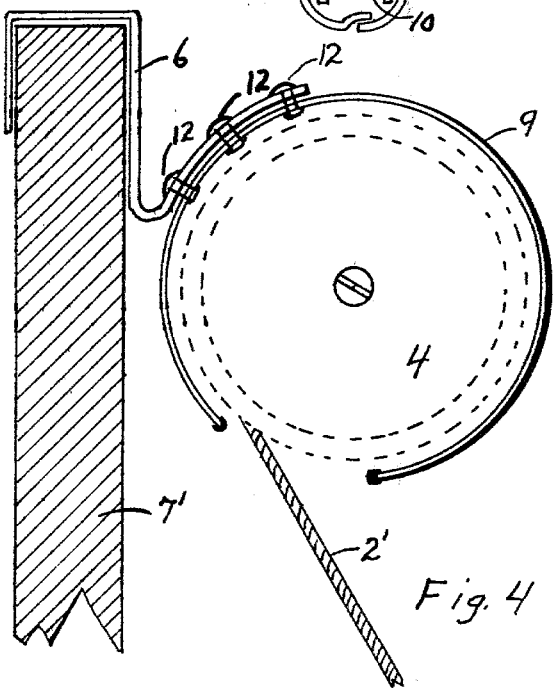
Fig. 4

GOLF SWING MUSCLE DEVELOPER

One of the great thrills and the great desire of the average golfer is to hit long and straight drives down the center of the fairway from the golf tees. Unlike many of the long hitters in golf the average player does not have the time and money to spend driving hundreds of golf balls daily on the practice tee. Their golf swing muscles do not get the opportunity to develop properly to enable the golfer to hit the long drives they would like so much to do. The regular use of this invention will enable the average golfer to increase the length of his golf drives.

This invention relates to athletic exercising equipment and has for its purpose to provide means for strengthening the muscles of the legs, back, abdomen, shoulders, arms, wrists and hands to enable a golfer to hit a longer, more powerful drive with a golf club and ball.

The main feature of this invention is to provide a rotatable pulley or reel attached to an inverted U-shaped mounting bracket, with a flexible cord attached to and wound around the pulley or reel, whose rotation is retarded or resisted by the strong force or tension of a coiled spring or elastic cord, with a handle of wood or other material attached to the other end of the flexible cord so that when the inverted U-shaped mounting bracket is hooked or fitted in place over the horizontal top of a door or other appropriate support the handle may be pulled downward and away from the pulley or reel in a simulated golf stroke downswing to unwind the flexible cord as it rotates the pulley or reel against the strong force or tension of the retarding or resisting coiled spring or elastic cord that is connected to the pulley or reel. By making many continuous and repeated downswings against the strong force of the resistance to the rotation of the pulley or reel all muscles used in driving a golf ball are strained and strengthened, enabling the golfer to drive a golf ball farther when playing on a golf course.

A further feature of this invention is to provide complete portability of this golf swing muscle developer by allowing the spring or elastic cord resisted pulley or reel with its inverted U-shaped mounting bracket to be easily and instantly installed or removed from the top of a door or other support as desired.

Further features of this invention and further objects to be attained will be described in the following specification. It is to be understood that the invention resides mainly in the inverted U-shaped mounting bracket supporting a pulley or reel that is wound with a flexible cord attached to a handle that, when pulled away from the pulley in a simulated golf stroke downswing, rotates the pulley against the strong resisting force of a coiled spring or elastic cord attached to the rotatable pulley or reel to strain and strengthen a golfer's muscles to enable the golfer to hit longer drives when playing on a golf course.

More specific objects and features of this invention will become apparent from the following specification and description when considered in connection with the accompanying drawings, in which:

FIG. 1 is a drawing of a man holding the handle of the golf swing muscle developer, with its inverted U-shaped mounting bracket installed over the top of a door, as he is about to start his simulated golf stroke downswing and also as he completes his simulated golf stroke backswing.

FIG. 2 is a drawing of a man holding the handle of the golf swing muscle developer with its inverted U-shaped mounting bracket installed over the top of a door as in FIG. 1, but with the handle and flexible cord nearly fully extended from the pulley or reel as the simulated golf stroke downswing is almost completed.

FIG. 3 is an enlarged view of the golf swing muscle developer as shown in FIG. 1, showing the inverted U-shaped mounting bracket hooked or fitted over the horizontal top of a door or other support and with the entire side of the mounting bracket fitting closely against the vertical side of the door or other support.

FIG. 4 is an enlarged view of the golf swing muscle developer shown in FIG. 2 using an inverted U-shaped mounting bracket with its lower end bent out at an angle from the door or other support and fastened to the axle supporting case that partially encloses the spring or elastic cord resisted rotatable pulley or reel.

FIG. 5 is a side view of the outside of a spring resisted or spring loaded rotatable pulley, as shown in FIGS. 1, 2, 3 and 4, that may contain a spiral shaped clock-type constant force coiled spring within it to resist the rotation of the pulley.

FIG. 6 is a front view of the spring loaded pulley, as in FIGS. 1, 2, 3, 4 and 5, enclosed within the two sides of its axle supporting case as in FIGS. 2 and 4 and showing some of the windings of the flexible cord around the outside of the enclosed spring loaded pulley.

Figure 9:
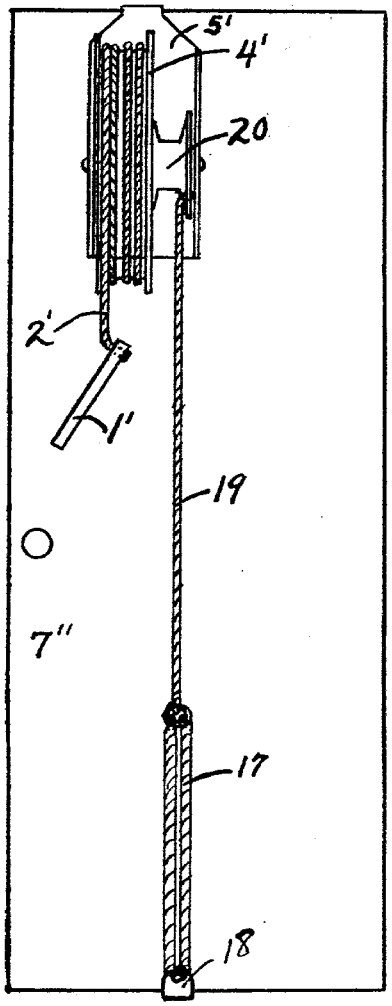

FIG. 9 is a frontal view of the golf swing muscle developer similar to that shown in FIGS. 1 and 3, but with one or more elastic cords or elongated coiled springs attached to the bottom of a door or other support at one end, the other end of the elastic cord or coiled spring being connected to a flexible cord that is attached to a groove of the pulley to resist the rotation of the pulley when the operator pulls the handle away from the pulley in a simulated golf stroke downswing as in FIGS. 1 and 2.

As shown in FIGS. 1 and 3 this golf swing muscle developer consists essentially of a handle 1 attached to a flexible cord 2 that is wound in several turns onto and attached to a spring resisted pulley 4 that rotates on axle 3 and is attached by an inverted U-shaped mounting bracket 5 to a door 7 or other supporting structure so that the operator 8 can pull the handle 1 and flexible cord 2 downward and away from the pulley 4 in a simulated golf stroke downswing against the strong resisting force or tension of the resisting coiled spring that may be contained within the pulley 4.

As shown in FIGS. 2 and 4 the spring resisted pulley 4 may be contained within the partially enclosing axle support case 9 which is itself connected by fasteners 12 to the inverted U-shaped mounting bracket 6 that attaches the golf swing muscle developer to a door 7 or other adequate support so that the operator 8 may pull the handle 1 and flexible cord 2 downward and away from the pulley 4 in a simulated golf stroke downward against the force of the spring resisted pulley 4.

As shown in FIG. 5 the pulley 4 rotates upon the axle 3. The pulley 4 may contain within its hollow interior a spiral shaped, clock-type coiled spring attached at one end to the stationary axle 3 and at its other end to the inside of the pulley 4, construction and operation of which is well known to anyone skilled in the art and is commonly known as a spring-loaded pulley or reel.

As shown in FIG. 6 the pulley 4 rotates upon axle 3 which is attached by fasteners 11 to the two sides of the axle supporting case enclosure 9; also a few turns of the flexible cord 2 are shown at 10 wound around the groove of the pulley 4 that is partially enclosed by the case 9.

Figure 7:
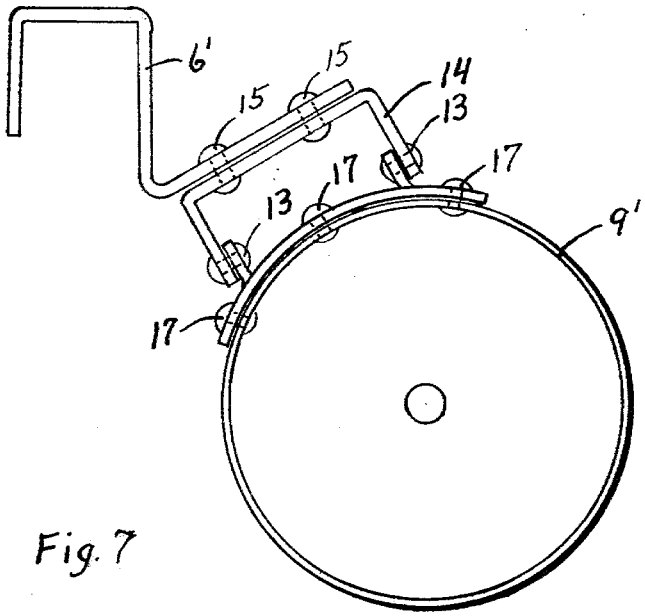
FIG. 7 is a side view of the inverted U-shaped mounting bracket as may be used in FIGS. 2, 4, 5 and 6, but with the inverted U-shaped mounting bracket attached to a swivel jointed support bracket connected to the axle support case enclosing the spring loaded rotatable reel.

As shown in FIG. 7 the spring resisted pulley supporting case 9' may be attached by fasteners 17 to a bracket 14 that is swivel jointed at fasteners 13 and attached at 15 to the inverted U-shaped mounting bracket 6' that may be hooked or placed over the top of a door or other support as in FIGS. 1, 2, 3 or 4.

Figure 8:
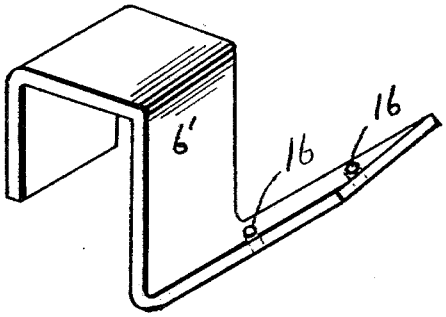
FIG. 8 is an angular view of the inverted U-shaped mounting bracket shown in FIG. 7 and similar to that used in FIGS. 2, 4, 5 and 6, but before the inverted U-shaped mounting bracket is attached to the axle supporting case of the spring loaded pulley or reel.

As shown in FIG. 8 the inverted U-shaped mounting bracket 6' may be provided with holes 16 in its angular bent wing or ear for attaching the swivel jointed bracket 14 and supporting case 9' as in FIG. 7.

As shown in FIG. 9 the golf swing muscle developer, as shown in FIGS. 1 and 3, may have the rotation of its pulley or reel 4' resisted by one or more elastic cords 17 attached at one end to the bottom of the supporting door 7" or other support as at 18 which may be a bracket inserted under the door 7" to also prevent movement of the door 7" during the operation of the golf swing muscle developer. The other end of the elastic cord 17 is connected to a flexible cord 19 that is attached to a groove 20 of the pulley 4' that is mounted upon the top of the door 7" by the inverted U-shaped mounting bracket 5' as shown in FIGS. 1 and 3.

The operation of the golf swing muscle developer when attached to a door or other adequate support by its inverted U-shaped mounting bracket as shown in FIGS. 1, 2, 3 and 4 is as follows:

When the operator 8 pulls the handle 1 and flexible cord 2 downward and away from the pulley or reel 4 the partial unwinding of the flexible cord 2 from the groove of the pulley 4 causes the pulley 4 to rotate upon the axle 3 against the strong resistance or force of the spiral shaped, clock-type coiled spring enclosed within the hollow compartment within the pulley 4—as is well known by anyone skilled in the art—as this rotation of the pulley 4 winds-up or tightens this flat coiled constant-force spiral shaped spring within the pulley 4, requiring the application of a strong force or pull by the operator 8 upon the handle 1 of the golf swing muscle developer. When the operator 8 completes his simulated golf stroke downswing as in FIG. 2 and returns the handle 1 and flexible cord 2 to its original starting position, as in FIG. 1, the coiled spring enclosed within the pulley 4 automatically rewinds the flexible cord 2 upon the groove of the pulley 4 so that the operator 8 may again perform another simulated golf stroke downswing. Repeated exercises with this golf swing muscle developer, as just described, soon requires a great effort by the operator 8 as his muscles become tired and strained by this exertion and this frequent straining of this muscles used in this simulated golf stroke downswing will strengthen these muscles over a period of time, enabling the golfer to hit longer drives with a golf club and ball when playing on a golf course.

The operation of the golf swing muscle developer as shown in FIG. 9 is as follows: With the inverted U-shaped mounting bracket 5' attached to the top of a door 7" or other support as also shown in FIGS. 1 and 3, the operator can pull the handle 1' and flexible cord 2' downward and away from the pulley 4' attached to the mounting bracket 5'. As the handle 1' is pulled away from the pulley 4', by the operator in a simulated golf stroke downswing, the flexible cord 2' partially unwinds from the pulley 4' causing the pulley 4' to rotate and partially wind the flexible cord 19 in the groove 20 of the pulley 4' against the strong force or tension of the elastic cords 17 as the elastic cords 17 are stretched by this action. As the operator returns the handle 1' toward the pulley 4' in a simulated golf stroke backswing the contracting action of the elastic cords 17 reverses the direction of rotation of the pulley 4' as it unwinds the flexible cord 19 from pulley groove 20 and this action rewinds the flexible cord 2' upon the groove of pulley 4'. Repeated operation of this golf swing muscle developer will soon strain and, over a period of time, strengthen the muscles used in a golf stroke downswing, enabling the golfer to drive a golf ball farther when playing on a golf course.

I claim:

1. A golf swing muscle developer comprising a handle; a flexible cord; an axle support bracket having a stationary axle attached thereto; a pulley rotatably mounted upon said stationary axls; an inverted U-shaped mounting bracket having said axle support bracket attached thereto; a spring means to resist the rotation of said pulley; said flexible cord having one end connected to said handle and having its other end wound around and attached to said pulley; said axle support bracket including two half-shells with an opening for said flexible cord to pass through; said stationary axle being attached at each end to one of each of said half-shells; said U-shaped mounting bracket having an extension bent outwardly from the U-shaped portion and fastened to one of said half-shells whereby said pulleys may be easily and instantly and removed from the horizontal top of a door or other supporting structure; means for anchoring one end of said spring means to a stationary support and means for connecting the other end of said spring means to said pulley whereby the pulling of said handle away from said pulley, by an operator in performing a simulated golf stroke downswing, causes said flexible cord to unwind on the groove of said pulley and to rotate said pulley on said stationary axle against the strong resisting force of said spring means as said springs means is stretched by this action; said spring means reverses the rotation of said pulley and automatically rewinds said flexible cord in the groove of said pulley when the operator returns said handle toward said pulley when making a simulated golf stroke backswing.

2. A golf swing muscle developer according to claim 1 wherein said inverted U-shaped mounting bracket includes a swivel joint located between the inverted U-shaped portion of said mounting bracket and that portion of said mounting bracket that connects to said axle support bracket whereby said pulley and said support bracket may swivel from side to side as the operator pulls said handle in performing a simulated golf stroke downswing.

3. A golf swing muscle developer comprising a handle; a first flexible cord; an axle support bracket having a stationary axle attached thereto; a pulley rotatably mounted upon said stationary axle; an inverted U-shaped mounting bracket having said axle support bracket attached thereto; a spring means to resist the rotation of said pulley; said first flexible cord having one end connected to said handle and having its other end wound around and attached to said pulley; means for attaching said inverted U-shaped mounting bracket to the horizontal top of a door or other supporting surface; and said spring means comprising an elastic cord attached at one end to a stationary support, the other end of said elastic cord connected by a second flexible cord to a groove of said pulley whereby the rotation of said pulley, when an operator pulls said handle away from said pulley in performing a simulated golf stroke downswing, winds said second flexible cord on said pulley against the strong resisting force of said elastic cord as said elastic cord is stretched by this action.

4. A golf swing muscle developer comprising a handle; a first flexible cord; an axle support bracket having a stationary axle attached thereto; a pulley rotatably mounted upon said stationary axle; an inverted U-shaped mounting bracket having said axle support bracket attached thereto; a spring means to resist the rotation of said pulley; said first flexible cord having one end connected to said handle and having its other end wound around and attached to said pulley; means for attaching said inverted U-shaped mounting bracket to the horizontal top of a door or other supporting surfaces; and said spring means comprising an elongated coiled spring attached at one end to a stationary support, the other end of said elongated coiled spring connected by a second flexible cord to a groove of said pulley whereby the rotation of said pulley, when the operator pulls said handle away from said pulley in performing a simulated golf stroke downswing, winds said second flexible cord on said pulley against the strong resisting force of said elongated coiled spring as said elongated coiled spring is stretched by this action.

* * * * *